US005528658A

United States Patent [19]

Hell

[11] Patent Number: 5,528,658

[45] Date of Patent: Jun. 18, 1996

[54] X-RAY TUBE HAVING AN ANNULAR VACUUM HOUSING

[75] Inventor: Erich Hell, Erlangen, Germany

[73] Assignee: Siemens Aktiengesellschaft, Munich, Germany

[21] Appl. No.: 513,513

[22] Filed: Aug. 10, 1995

[30] Foreign Application Priority Data

Sep. 28, 1994 [DE] Germany ..... 44 34 704.9

[51] Int. Cl.[6] ..... H01J 35/30; H01J 35/24

[52] U.S. Cl. ..... 378/137; 378/121; 378/145

[58] Field of Search ..... 378/119, 121, 378/123, 135, 137, 138, 145, 146

[56] References Cited

U.S. PATENT DOCUMENTS

| | | | |
|---|---|---|---|
| 4,203,036 | 5/1980 | Tschunt | 250/445 T |
| 5,172,401 | 12/1992 | Asari et al. | 378/137 |
| 5,197,088 | 3/1993 | Vincent et al. | 378/137 |
| 5,224,137 | 6/1993 | Plomgren et al. | 378/137 |
| 5,247,556 | 9/1993 | Eckert et al. | 378/4 |

FOREIGN PATENT DOCUMENTS

| | | |
|---|---|---|
| 0455177 | 11/1991 | European Pat. Off. . |
| 2044985 | 10/1980 | United Kingdom . |

*Primary Examiner*—Don Wong

*Attorney, Agent, or Firm*—Hill, Steadman & Simpson

[57] ABSTRACT

An x-ray tube has an annular vacuum housing through which an electron beam passes in an annular path, an annular target from which x-radiation emanates during operation of the x-ray tube when the electron beam strikes it at a point of incidence, and a beam deflector which is movable along the circumference of the vacuum housing and which deflects the electron beam such that it is incident onto the target at a point of incidence that is dependent on the position of the deflector along the circumference of the vacuum housing. An x-ray beam emanating from the target is thus caused to move around the interior of the vacuum housing in the manner necessary for producing computed tomograms of a subject disposed in the interior of the vacuum housing.

8 Claims, 5 Drawing Sheets

X-RAY TUBE HAVING AN ANNULAR VACUUM HOUSING

BACKGROUND OF THE INVENTION

1. Field of the Invention

The present invention is directed to an x-ray apparatus having an annual vacuum housing within which an electron beam is caused to follow an annular path and is deflected from the annular path onto a target, thereby causing x-rays to be emitted from the target in a beam which is movable around the vacuum housing.

2. Description of the Prior Art

X-ray tubes are known which have an annular vacuum housing, an electron beam source which emits an electron beam entering into the vacuum housing, means in the housing for accelerating the electron beam, first deflection means for deflecting the electron beam such that it passes through the vacuum housing on an annular path, a target from which x-radiation emanates during operation of the x-ray tube when the electron beam is incident thereon, and second deflection means for deflecting the electron beam such that it is incident on the target surface, preferably substantially perpendicularly, in a desired position. It is also known to employ such an x-ray tube, in a computed tomography apparatus also having a detector unit and collimator means that limits the x-rays emanating from the point of incidence on the target during operation of the x-ray tube as a fan-shaped x-ray beam is incident on the detector unit.

X-ray tubes of the type initially cited are particularly useful for computed tomography because the demands made in a computed tomography system on conventional x-ray tubes are so high that their service life is extremely short compared to other radiological applications of such tubes. Moreover, in the increasingly employed spiral scan mode, in a computed tomography apparatus having a conventional x-ray tube, the tube must be electrically supplied with wiper rings. Wiper rings are relatively complicated and expensive, and may cause considerable disturbances in the electronics of the computed tomography apparatus due to contacting problems at the wiper rings as a consequence of the high accelerating voltage of the x-ray tube. Lastly, the image quality is disadvantageously influenced as a consequence of the extrafocal radiation emanating from conventional x-ray tubes.

X-ray tubes of the type initially described are advantageous here because

- a rotating anode is not required, and thus the problems associated with rotating anodes (durability of the bearing, running noises) are avoided;
- insulation problems cannot occur when the target material evaporates during operation since the target is located outside the electron beam source;
- wiper rings are not required for the spiral scan mode and the disturbances associated therewith are thus avoided; and
- deterioration of the image quality due to extrafocal radiation cannot occur.

European Application 0 455 177 discloses an x-ray tube of the types initially described wherein, in a first embodiment, the aforementioned second deflector means is formed by a plurality of electromagnetic deflector elements arranged at equal intervals along the circumference of the vacuum housing. By successively activating the electromagnets, the path of the electron beam is controlled such that the point of incidence of the electron beam on the target is displaced along the circumference of the target in a scan motion in the way required for computed tomography. As a consequence of the large number of electromagnets required as well as the associated control circuitry, this solution is complicated and expensive. According to another embodiment disclosed in European Application 0 455 177—a corresponding x-ray tube is also disclosed by German OS 41 03 588—, the second deflector means are formed by a single deflector element placed at the circumference of the vacuum housing, again an electromagnet, whereby the field strength of the magnetic field generated with the electromagnetic is controlled such that the point of incidence is displaced along the circumference of the target in the required way. In this case, it is difficult to control the field strength such that the motion of the point of incidence ensues synchronously with the motion of the detector unit, as is required for computed tomography.

British Specification 2 044 985 discloses an x-ray tube having an annular target wherein a selectively activated electrostatic deflector element, such as an electrode, out of a plurality of electrostatic deflector elements arranged at equal intervals along the circumference of the vacuum housing is employed as the second deflector means. By successively activating the deflector elements, the electron beam is deflected such that the point of incidence of the electron beam is displaced along the circumference of the target in a scan motion.

German OS 26 20 237 also discloses an x-ray tube with an annular target and having a plurality of cathodes arranged at equal intervals along the circumference of the annular target. By successively activating the cathodes, a subject to be examined is transirradiated with x-ray beams from different directions in the manner of a scan procedure.

SUMMARY OF THE INVENTION

An object of the present invention is to provide an x-ray tube of the type initially described wherein the second deflector means are simply economically constructed and the prerequisites for a good synchronization of the motion of the point of incidence with the motion of the detector unit of a computed tomograph are met.

It is a further object of the invention to provide a computed tomography apparatus of the type initially described wherein a good synchronization of the motion of the point of incidence with the motion of the detector unit is assured in a simple and economic.

The first object is achieved in an x-ray having an annular vacuum housing, an electron beam source which emits an electron beam entering into the vacuum housing and including means for accelerating and focusing the electron beam, first deflector means for deflecting the electron beam such that it passes through the vacuum housing on an annular path, an annular target from which x-rays emanate during operation of the x-ray tube when the electron beam is incident thereon, and second deflector means for deflecting the electron beam during operation of the x-ray tube such that the electron beam is incident on the target at a point of incidence, with the vacuum housing and the second deflection means being adjustable relative to one another in the circumferential direction of the vacuum housing so that the position of the point of incidence is dependent on the position of the second deflection means along the circumference of the vacuum housing.

In the inventive x-ray tube, the vacuum housing and the second deflection means are not stationary as in known tubes; on the contrary, they are mechanically adjusted relative to one another in the circumferential direction of the vacuum housing, i.e. in the sense of a positional change. It is therefore not necessary to provide second deflection means having a plurality of deflection elements-the second deflection means of the invention are preferably formed by a single, second deflection element, as a result of which a simplified structure is achieved.

At the same time, the imprecisions that are assigned with the use of a single stationary deflector element are avoided, since there is the possibly of rigidly joining the second deflection means and the detector unit to one another.

It is also possible to use second deflection means in the invention functioning according to the electrostatic principle. In a preferred embodiment of the invention, however, for reasons of simplicity and reliability, the second deflection means is formed by a magnet. This can be an electromagnet or a permanent magnet, or a coil. When an electromagnet or a coil is employed, the current supply can ensue with suitable induction coils, as in the case of speaker diaphragms, in order to avoid the use of wiper rings and the like.

In order to obtain a simple structure of the x-ray tube, in one version of the invention the second deflection means are adjustable along the circumference of the stationary vacuum housing for producing the relative motion. It is also possible, however, to keep the second deflection means stationary and to adjust the vacuum housing, or to adjust both the second deflection means and the vacuum housing. These latter two approaches, however, involve more technological outlay.

The second directed to a computed tomography apparatus is achieved in accordance with the principles of the invention in two components in a computed tomography apparatus having an inventive x-ray tube as described above, a detector unit that is adjustable along the circumference of the vacuum housing of the x-ray tube in a manner synchronized with the second deflection means (i.e., these two components are moved together at the same speed and direction). A collimator is provided for limiting the spatial spread of the x-rays such that the x-radiation emanating from the (moving) point of incidence during operation of the x-ray tube is gated so that a fan-shaped x-ray beam is incident onto the detector unit. A good synchronization of the motion of the point of incidence with the motion of the detector unit is thus assured in a simple and economic way. In one version of the invention, the synchronization can be realized especially economically by connecting the detector unit to the second deflection means. Preferably, the connection ensues mechanically. There is also the possibility, however, of producing a defined synchronization in some other way, for example if the second deflection means and the detector unit each have separate drive motors respectively allocated to them, these motors can be operated such that a synchronous motion of the second deflection means and of the detector unit along the circumference of the vacuum housing ensues.

In order to achieve a compact structure of the computed tomography apparatus, in one version of the invention provides that the collimator means are connected to the second deflection means.

DESCRIPTION OF THE PREFERRED EMBODIMENTS

Figure 1:
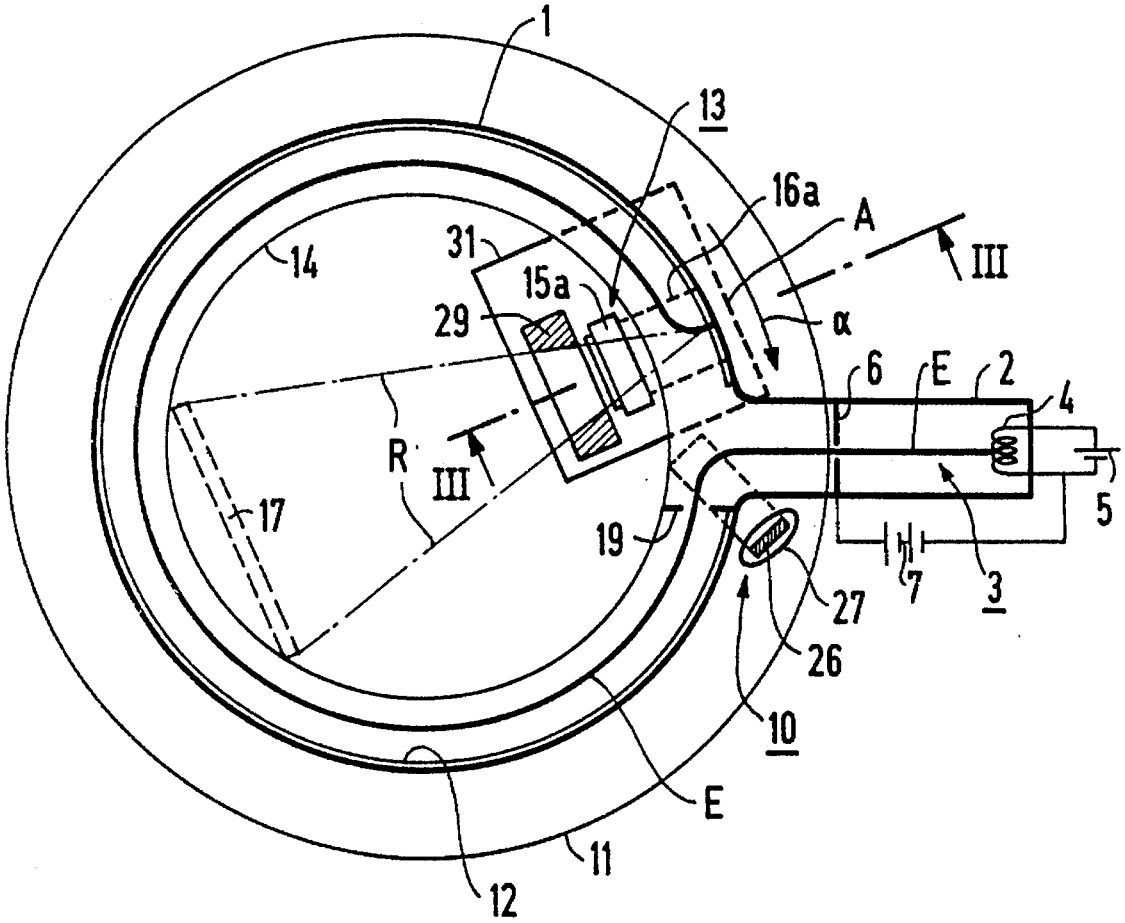
FIG. 1 is a schematic illustration of an inventive x-ray tube in a sectional view.

As shown in FIG. 1, the inventive x-ray tube has an annular vacuum housing 1 that, in the case of the exemplary embodiment being described, is provided with a radially outwardly directed projection 2 that accepts an electron beam source (shown in greater detail in FIG. 2) generally referenced 3 which is shielded against electromagnetic disturbances. The projection 2 can alternately be tangentially or axially directed.

The electron beam source 3 contains a cathode 4, for example a glow coil, to which a filament voltage source 5 is allocated. When the filament voltage source 5 is activated, an electron beam E is emitted by the cathode 4. This electron beam E is accelerated in the direction toward an apertured anode diaphragm 6, by means of an acceleration voltage source 7 connected across the one terminal of the cathode 4 and the apertured anode diaphragm 6. Two magnetic lenses in the form of focusing coils 8 and 9 are provided for focusing the electron beam E which passed through the apertured anode diaphragm 6. The focusing coils 8 and 9 focus the electron beam E such that it has at least a substantially constant, preferably elliptical or circular, cross section over its entire length following the focusing coil 9. A quadrupole system 28 that serves the purpose of modulating the electron beam E along the annular path follows the focusing coil 9.

Instead of containing a glow coil heated by direct current flow therein, the electron beam source 3 may alternately contain a differently shaped and/or indirectly heated cathode. Further, the electron beam source 3 may be an electron gun.

First deflection means, that are stationary with reference to the vacuum housing 1, are arranged in the region of the transition of the projection 2 into the annular vacuum housing 1. The first deflection means deflect the electron beam E such that it subsequently follows a circular path within the annular vacuum housing 1. In the case of the described exemplary embodiment, the first deflection means are formed by an electromagnet 10 having a U-shaped yoke 26 (which carries windings 27) embracing the vacuum housing 1 and generating a magnetic field that is directed at a right angle relative to the plane of the drawing of FIG. 1.

In order to keep the electron beam in its circular path, a schematically indicated Helmholtz coil pair 11 is provided that likewise generates a magnetic field proceeding at a right angle relative to the plane of the drawing of FIG. 1 but that is directed oppositely to the magnetic field of the electromagnet 10.

Instead of the Helmholtz coil pair 11, annular pole shoes can be arranged above and below the annular vacuum housing 1 in a known way or, as is standard in accelerator technology, dipoles and/or quadrupoles can be provided.

A target 12 that extends along the interior outermost wall of the vacuum housing 1 is provided inside the annular vacuum housing 1. The target 12 contains a material, for example tungsten, that is suitable for the emission of x-rays.

Second deflection means, preferably in the form of a deflector magnet 13, are provided in order to be able to deflect the electron beam E out of its annular path and onto the target 12 for generating x-radiation. The magnetic field of the deflector magnet 13 is opposite the magnetic field of the Helmholtz coil pair 11 and therefore deflects the electron beam E radially outward, so that it is incident on the target 12 at a point of incidence A, preferably at substantially a right angle.

The x-radiation emanating from the point of incidence A emerges through an annular beam exit window 14 that is formed in the inner wall of the vacuum housing 1 of a suitable material having a low atomic number, for example beryllium.

Figure 3:
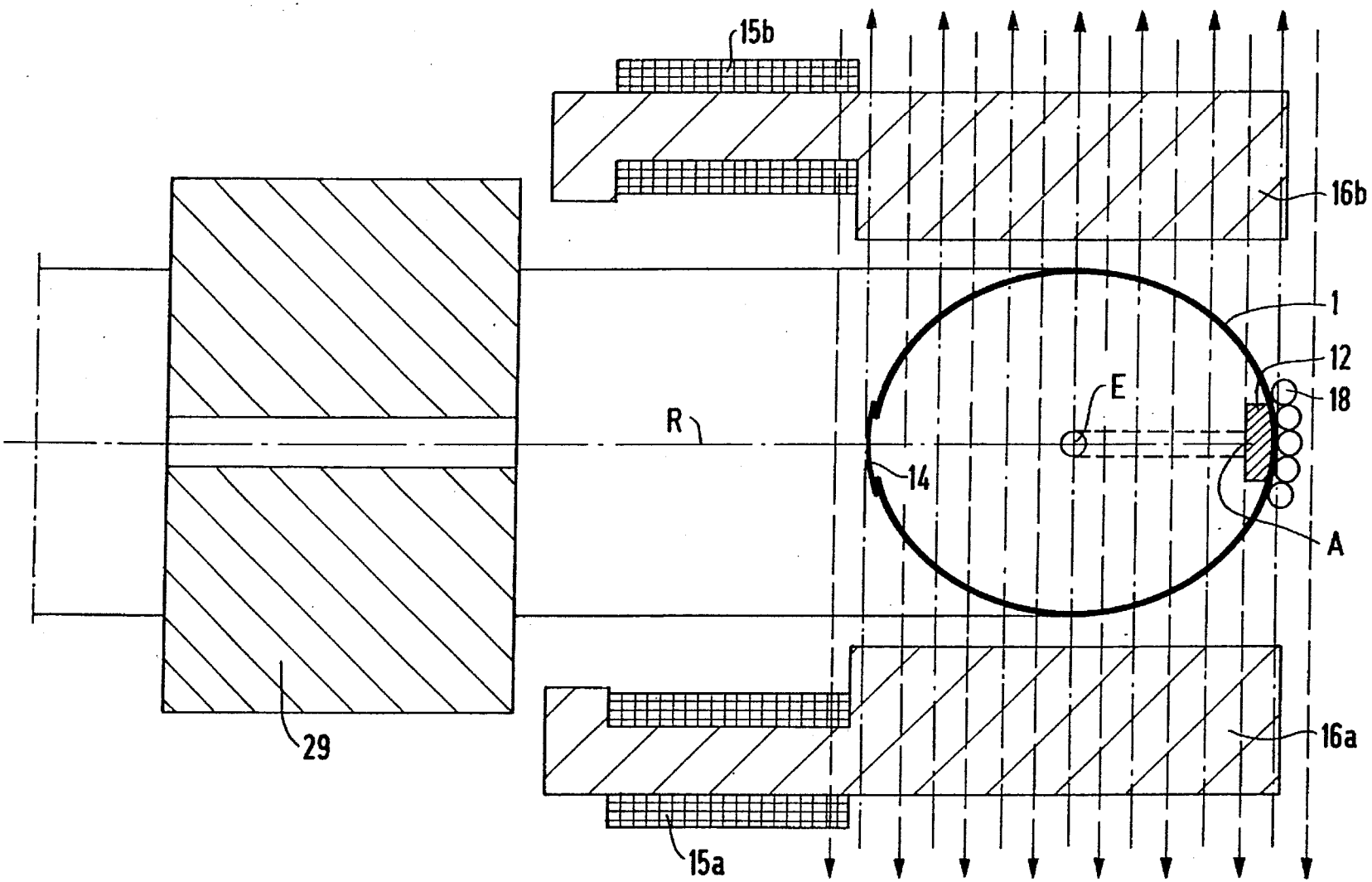
FIG. 3 is a section through the inventive x-ray tube along the line III—III of FIG. 1.

The deflection magnet 13 in the exemplary embodiment being described is an electromagnet that has two windings 15*a* and 15*b* carried on a yokes 16*a* and 16*b*, as shown in FIG. 3. The yokes 16*a* and 16*b*, which are connected to one another in a way that is not shown, also blank out stray and extrafocal radiation.

In the exemplary embodiment being set forth, a collimator 29 for the x-radiation emanating from the point of incidence A is provided (FIG. 3). As can be seen in conjunction with FIG. 1, the collimator 29 in the exemplary embodiment being set forth blocks the x-radiation such that a fan-shaped x-ray beam as is required for computed tomography is shaped. A collimator, however, need not necessarily be a component of the inventive x-ray tube.

The field lines of the magnetic field of the Helmholtz coil pair 11 are also shown as dashed lines in FIG. 3 and those of the deflection magnetic 13 are shown as dot-dashed lines, whereby the arrows illustrate the direction of each magnetic field.

As also shown in FIG. 3, a cooling means are allocated to the target 12. In the case of the exemplary embodiment being described, the cooling means are a coolant line 18 helically wound onto the outer wall of the vacuum housing 1 in the region of the target 12.

In order to be able to displace the point of incidence A of the electron beam E onto the target 12 along a circular path following the circumference of the target 12, as required for computed tomography, in a simple and precise way, the deflection magnet 13 together with the collimator 29 are adjustable along the circumference of the vacuum housing 1 with an adjustment assembly 31. As a result, the point of incidence A is analogously displaced along the circumference of the target 12 corresponding to the respective position of the deflection magnet 13. The adjustment of the deflection magnet 13 and the collimator 29 can ensue with the common adjustment assembly 31 including a rigid connection of the deflection magnet 13 to the collimator 29. Alternatively, the assembly 31 may include separate drives for the deflection magnet 13 and the collimator 29, these separate drives being operated in a manner so as to cause the aforementioned synchronized movement of the deflection magnet 13 and the collimator 29 along the circumference of the target 12.

When the x-ray tube is used for computed tomography, the collimator 29 must be fashioned in the way shown in FIG. 1 such that it shapes an x-ray beam R that is incident onto the detector unit 17 of the computed tomography apparatus.

A diaphragm 19 that limits (selects) the electron energy spectrum to a desired monochromatic electron energy is provided within the annular vacuum housing 1 at the beginning of the annular path of the electron beam E. Further, the electromagnet 10 also simultaneously selects the electrons according to their energy in case the energy of the electrons is no longer mono-energetic as a consequence of impacts with any residual gas which may be contained in the vacuum housing 1.

Figure 2:
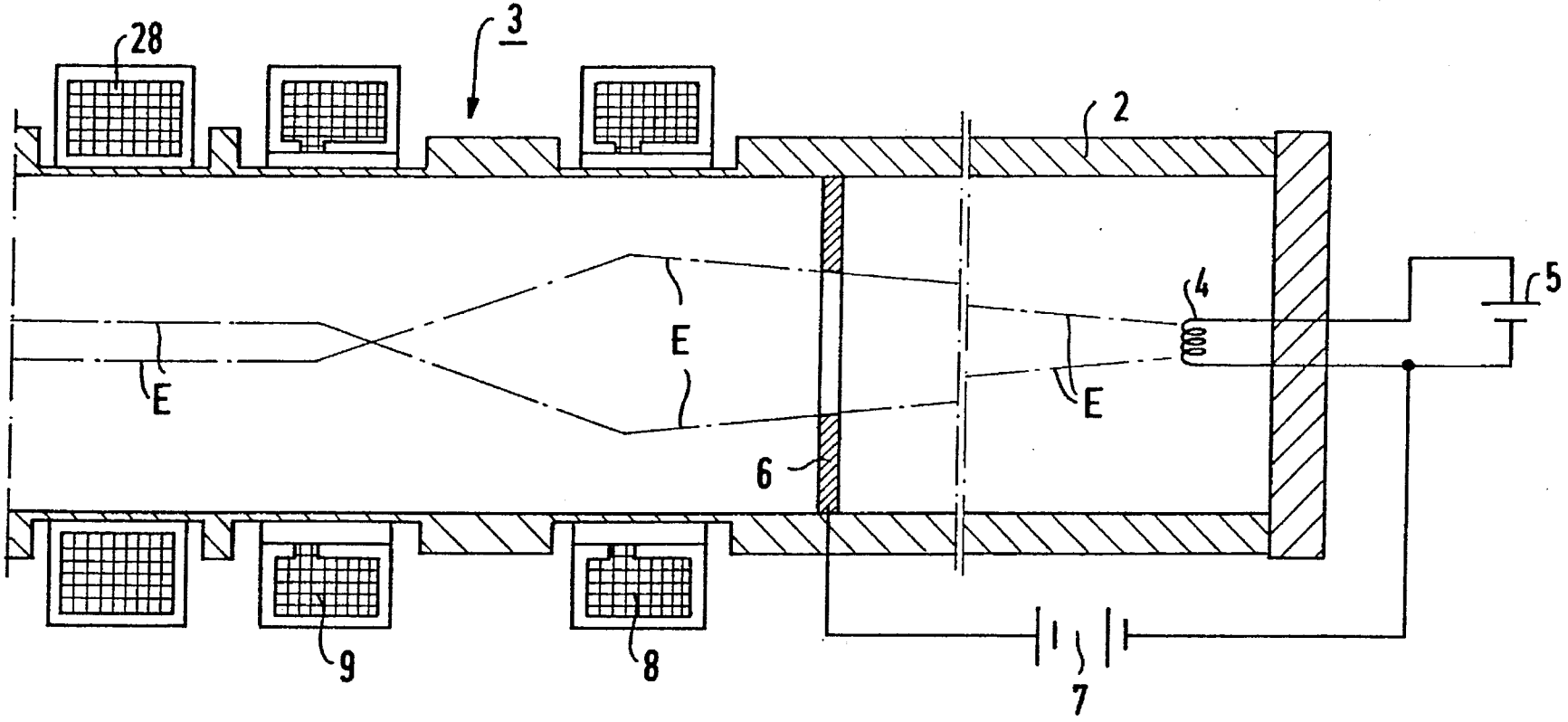
FIG. 2 illustrates the electron beam source of the x-ray tube according to FIG. 1 in a longitudinal section, shown schematically.
Figure 4:
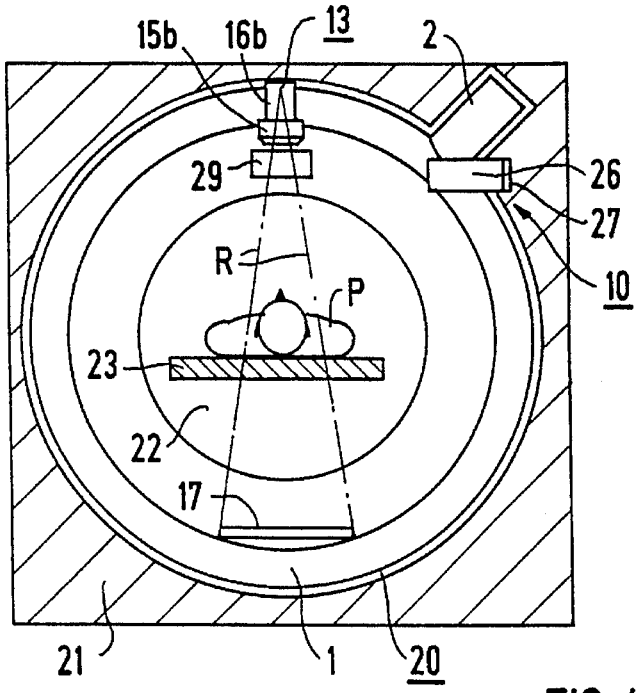
FIG. 4 is a section (illustrated schematically) along the line IV—IV of FIG. 5 through an inventive computed tomography apparatus.
Figure 5:
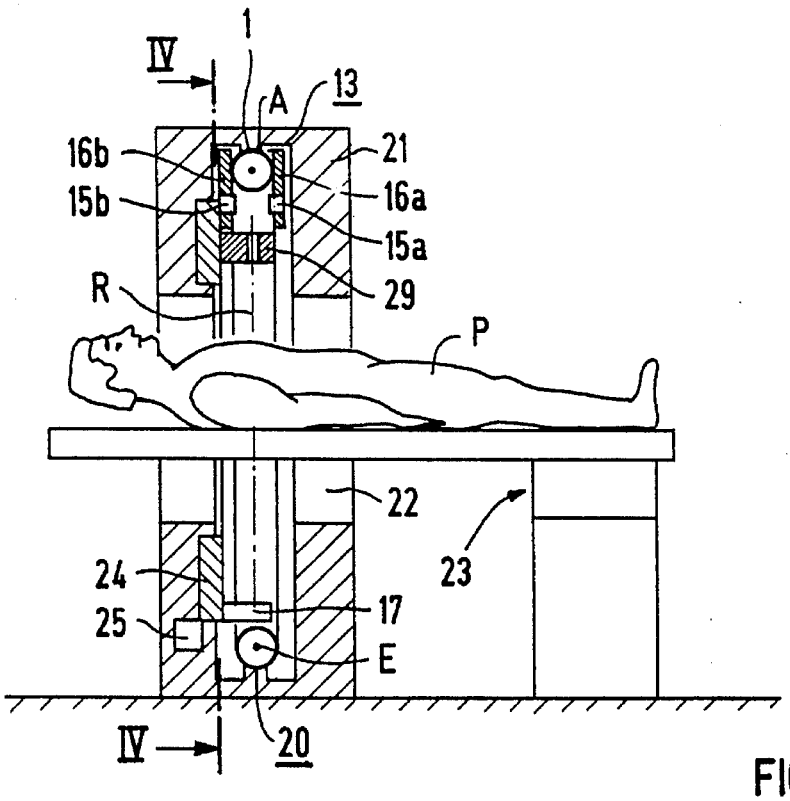
FIG. 5 shows the computed tomography apparatus of FIG. 4 in a longitudinal section.

FIGS. 4 and 5 shown an inventive computed tomography apparatus having an x-ray tube according to FIGS. 1–3. The x-ray tube, generally referenced 20 (the Helmholtz coil pair 11 and the coolant line 18 are not shown for simplicity) is integrated into a housing that is referred to below as a gantry 21. The gantry 21 has an opening 22 aligned with the vacuum housing 1 of the x-ray tube 20. A bed 23 on which a patient P to be examined is placed extends through the opening 22. The patient P is then annularly surrounded by the x-ray tube 20 in the region to be examined. A live rim 24 is rotatably seated in the gantry 21 concentrically and coaxially with the x-ray tube 20. A motor 25 is provided for driving the live rim 24.

The deflection magnet 13 with the collimator 29 and the detector 17 are arranged at the live rim 24 opposite one another such that the fan-shaped x-ray beam R shaped by the collimator 29 is incident on the detector unit 17 as shown with dashed lines in FIG. 4 after penetrating the patient P. When the live rim 24 is driven with the motor 25, the deflection magnet 13 and the collimator 19, and thus the point of incidence A from which the x-radiation emanates, and the detector unit 17 are moved synchronously on a circular path in the way required for acquiring data for producing computed tomography images.*

Thus it is clear that the live rim 24 and the motor 25 function as adjustment assembly for the deflection magnet 13 as well as for the collimator 29 and the detector unit 17.

Apart from the above-described, special characteristics of the x-ray tube and the common movement of the deflection magnetic 13 with the collimator 29 and the detector unit 17, the computed tomography apparatus of FIGS. 4 and 5 is conventionally constructed. It is advisable, however, to undertake magnetic shielding measures in the region of the gantry 21 in order to minimize the influence of external magnetic noise fields on the operation of the computed tomography apparatus.

The generation of a so-called flying focal spot can also be provided in a known way within the scope of the conventional structure of the computed tomography apparatus. This means that the point of incidence A is displaced along the circumferential direction of the target 12 from a first position into a second position for each of the scan positions during the production of a computed tomogram. Improved image quality is thereby obtained since a doubled data set is available for imaging. In the case of the present invention, the flying focal spot can be generated in a simple way by modulating the field strength of the second deflection means in the necessary way. This is easily possible in the described exemplary embodiment by modulating the excitation current of the deflection magnet 13 fashioned as an electromagnet.

Figure 6:
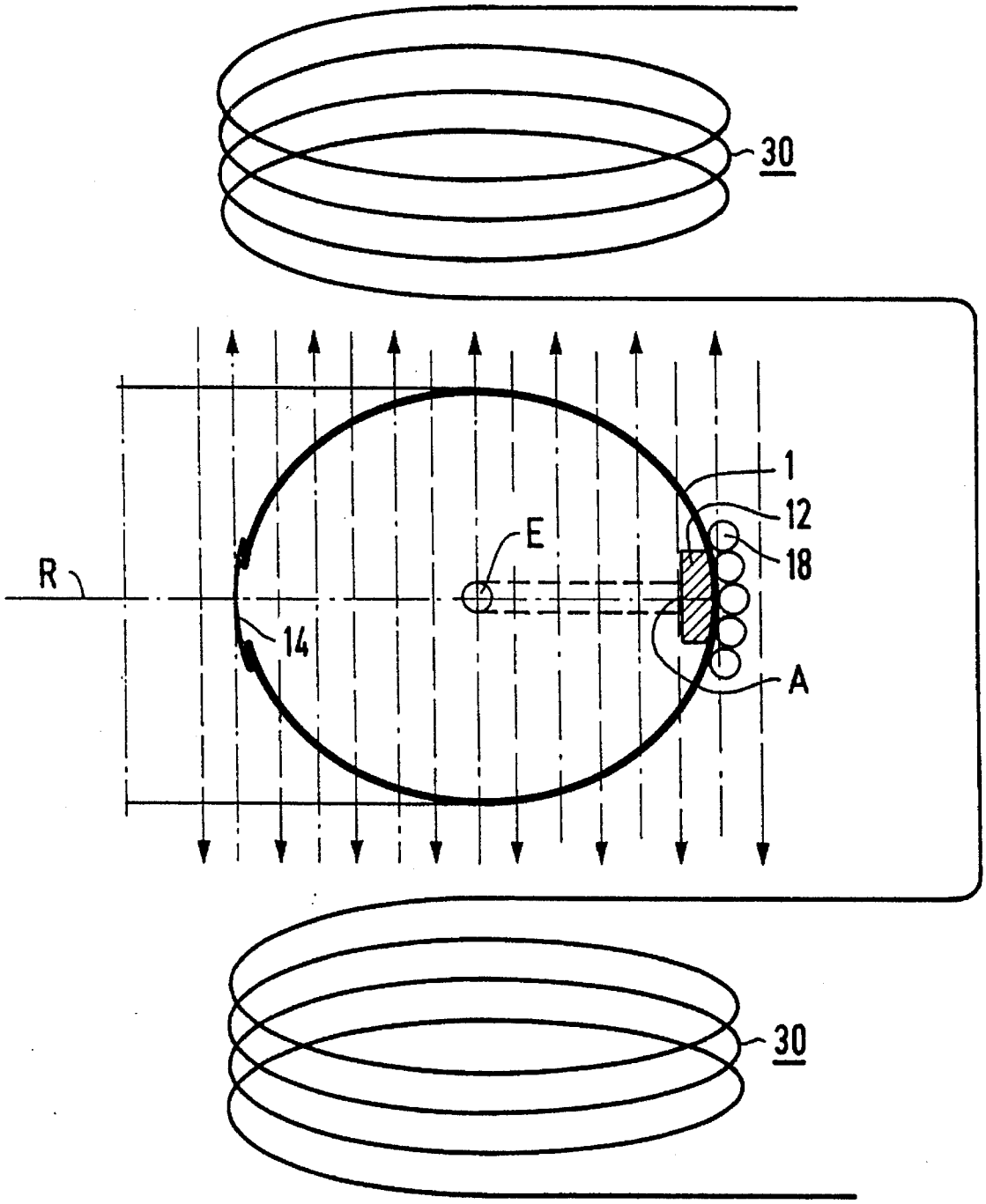
FIG. 6 shows a further embodiment of the x-ray tube of the invention shown in a view analogous to FIG. 3.

The exemplary embodiment of FIG. 6 differs from that set forth above in that the second deflection means are not formed by a magnet but instead by a (schematically indicated) Helmholtz coil pair 30 that generates a field directed oppositely to that of the first deflection means. The Helmholtz coil pair 30 is movable with adjustment means along the circumference of the vacuum housing 1 in common with a collimator that may be present in a manner analogous to that described above.

It is quite easy to replace the cathode of the electron beam source in the inventive x-ray tube. There is therefore the possibility of undertaking such a replacement at permanently prescribed maintenance intervals, so that a down time of the x-ray tube, or of the computed tomography apparatus which contains it, is very low. If a premature cathode replacement should nonetheless be required, then this can be quickly implemented.

It is self-evident that the inventive x-ray tube and the inventive computed tomography apparatus can be utilized conducting examinations other than for medical purposes. Employment thereof materials inspection is also possible; it is then recommended, however, to select an acceleration voltage that is increased compared to medical applications.

Instead of the electromagnet described in the described exemplary embodiments, a permanent magnet can be provided to form the first and/or second deflection means. Moreover, there is also the possibility of providing first and/or second deflection means which operate electrostatically instead of magnetically.

The mechanical adjustment of the vacuum housing 1 and the second deflection means relative to one another can, as described, ensue electromotively or with other suitable adjustment means, for example by pneumatic or hydraulic adjustment means.

Although modifications and changes may be suggested by those skilled in the art, it is the intention of the inventors to embody within the patent warranted hereon all changes and modifications as reasonably and properly come within the contribution of the art.

I claim as my invention

1. An x-ray apparatus comprising:

an annular vacuum housing having a circumference;

an electron beam source which emits an electron beam into said vacuum housing, said electron beam source including means for accelerating said electron beam;

first deflection means disposed for deflecting said electron beam for causing said electron beam to follow an annular path within and around said vacuum housing;

an annular target having a target surface disposed in said vacuum housing, said annular target emitting x-rays when struck on said target surface by said x-ray beam;

second deflection means disposed for deflecting said electron beam for causing said electron beam to strike said target at a point of incidence; and means for producing relative movement between said second deflection means and said vacuum housing along a circumferential direction of said vacuum housing for causing said point of incidence to move along said target surface dependent on the position of the second deflection means along the circumference of said vacuum housing.

2. An x-ray apparatus as claimed in claim 1 wherein said second deflection means comprises a magnet.

3. An x-ray apparatus as claimed in claim 1 wherein said second deflection means comprises at least one electrically energized coil.

4. An x-ray apparatus as claimed in claim 1 wherein said annular vacuum housing is stationary, and wherein said means for producing relative movement between said second deflection means and said vacuum housing comprises means for moving said second deflection means along the circumference of the stationary vacuum housing.

5. An x-ray apparatus as claimed in claim 4, further comprising:

an x-ray detector unit;

a collimator disposed in the path of the x-rays emanating from said point of incidence of said target for gating said x-rays to produce a fan-shaped x-ray beam; and means for moving said collimator and said detector unit along said circumferential direction of said stationary vacuum housing synchronously with the movement of said second deflection means along said circumferential direction for causing said fan-shaped x-ray beam to be incident of said detector unit.

6. An x-ray apparatus as claimed in claim 5 wherein said detector unit is mechanically connected to said second deflection means.

7. An x-ray apparatus as claimed in claim 5 wherein said collimator is mechanically connected to said second deflection means.

8. An x-ray apparatus as claimed in claim 5 wherein said detector unit and said collimator are both mechanically connected to said second deflection means.

* * * * *